US007017682B2

(12) United States Patent
Chan et al.

(10) Patent No.: US 7,017,682 B2
(45) Date of Patent: Mar. 28, 2006

(54) DRILL STRING SHUTOFF VALVE

(75) Inventors: Kwong-Onn C. Chan, Edmonton (CA); Behrooz Movaffagh, Edmonton (CA); Xiaoping He, Edmonton (CA); Loren Pierre Boisvert, Sherwood Park (CA)

(73) Assignee: Vetco Gray Inc., Houston, TX (US)

( * ) Notice: Subject to any disclaimer, the term of this patent is extended or adjusted under 35 U.S.C. 154(b) by 209 days.

(21) Appl. No.: 10/677,871

(22) Filed: Oct. 2, 2003

(65) Prior Publication Data

US 2004/0112643 A1 Jun. 17, 2004

Related U.S. Application Data

(63) Continuation-in-part of application No. 10/321,087, filed on Dec. 17, 2002, now Pat. No. 6,918,452.

(51) Int. Cl.
*E21B 17/18* (2006.01)

(52) U.S. Cl. ..... 175/57; 166/334.4; 166/386; 175/234; 175/306; 175/318

(58) Field of Classification Search ..... 166/334.1, 166/334.4, 386; 175/57, 232–235, 305, 306, 175/317, 318

See application file for complete search history.

(56) References Cited

U.S. PATENT DOCUMENTS

| | | | | |
|---|---|---|---|---|
| RE28,768 | E * | 4/1976 | Mason | 175/297 |
| 4,015,673 | A | 4/1977 | Craig, Jr. et al. | |
| 4,321,974 | A | 3/1982 | Klemm | |
| 4,509,606 | A | 4/1985 | Willis | |
| 4,596,294 | A | 6/1986 | Russell | |
| 4,705,119 | A | 11/1987 | Kostylev et al. | |
| 4,709,768 | A | 12/1987 | Kostylev et al. | |
| 4,790,391 | A | 12/1988 | Hamamura et al. | |
| 4,848,486 | A | 7/1989 | Bodine | |
| 4,854,397 | A | 8/1989 | Warren et al. | |
| 5,042,597 | A | 8/1991 | Rehm et al. | |
| 5,148,875 | A | 9/1992 | Karlsson et al. | |
| 5,165,491 | A | 11/1992 | Wilson | |
| 5,407,021 | A | 4/1995 | Kane et al. | |
| 5,435,400 | A | 7/1995 | Smith | |
| 5,538,091 | A | 7/1996 | Theocharopoulos | |
| 5,615,739 | A | 4/1997 | Dallas | |
| 5,957,226 | A | 9/1999 | Holte | |
| 6,047,784 | A | 4/2000 | Dorel | |
| 6,209,660 | B1 | 4/2001 | Cox | |
| 6,209,665 | B1 | 4/2001 | Holte | |

* cited by examiner

*Primary Examiner*—Zakiya Bates
(74) *Attorney, Agent, or Firm*—Bracewell & Giuliani LLP

(57) ABSTRACT

A valve assembly connects into a drill string for opening and closing a passage within the drill string. The valve assembly has an inner valve member for opening and closing an inner passage of the drill string. The valve member moves between the open and closed positions in response to axial movement of the drill string. Lifting the drill string causes the upper portion to move upward relative to the lower portion, bringing along with it the valve member, while the valve sleeve remains stationary with the lower portion, opening the valve. The valve assembly can include an annular valve assembly for opening and closing an annular passage located around the inner passage. The annular valve assembly is opened and closed by increasing the pressure in the annular passage above the annular valve assembly.

23 Claims, 7 Drawing Sheets

DRILL STRING SHUTOFF VALVE

RELATED APPLICATIONS

This continuation-in-part patent application claims the benefit of, non-provisional patent application U.S. Ser. No. 10/321,087, filed on Dec. 17, 2002, now U.S. Pat. No. 6,918,452, which is hereby incorporated by reference in its entirety.

BACKGROUND OF THE INVENTION

1. Field of the Invention

This invention relates in general to safety shutoff valves, and particularly to a safety shutoff valve located in a drill string for drilling a well.

2. Background of the Invention

Most oil and gas wells are drilled with a rotary drilling rig. Typically, the drill string has a drill bit on the end and is rotated to cause the drill bit to advance into the earth. A drilling fluid is pumped down the interior passage of the drill pipe, which exits nozzles on the drill bit and flows back up an annular space surrounding the drill pipe along with cuttings.

Normally, the drilling fluid is a liquid called mud, which has a weight selected to provide a hydrostatic pressure greater than the expected earth formation pressures. When tripping the drill string in and out of the hole, the drilling mud in the hole and within the interior of the drill pipe provide sufficient hydrostatic pressure to prevent a blowout. However, heavy drilling mud can damage certain earth formations, reducing their abilities to produce fluids after completion. For example, methane is located in certain fairly deep coal beds. The coal formations may be damaged by encroaching drilling mud.

Drilling with gaseous fluids, such as air, has also been done with oil and gas wells. In one of these techniques, compressed air flows down the interior of the drill pipe, exits the drill bit and flows back up the annulus. A single passage drill string is often used while performing this technique. A stripper seal surrounds the drill pipe at the surface for sealing the gas pressure in the well. Also, compressed air is used as a drilling fluid for drilling shallow mining blast holes.

Mining drilling rigs may alternatively employ a dual passage string of drill pipe, with one of the passages being an inner passage and the other an annular passage. A gaseous fluid such as air is pumped down the annular passage and flows back up the inner passage along with cuttings. The dual passage drill pipe can be rotated to rotate the drill bit. Alternately, a downhole motor can be utilized which may also create a reciprocating a hammer motion as well as rotating the drill bit while the drill pipe remains stationary.

The possibility of a blowout due to excessive earth formation pressure is not a factor with shallow drilling of mining blast holes. With deep oil and gas drilling, however, it must be considered both while drilling and while tripping the drill pipe in and out of the hole. Blowout preventers and rams are utilized to seal around the annulus of drill pipe. The use of check valves in the drill string has been proposed in the past. The primary barrier to a blowout, however, continues to be the use of drilling mud with sufficient weight to provide a higher hydrostatic pressure than any expected pressure of the earth formations.

SUMMARY OF THE INVENTION

In this invention, a valve assembly is mounted in a string of drill pipe for selectively closing the inner passage of the drill pipe. The valve assembly includes an interior valve assembly located within a central passage of the drill string. The interior valve is closed by selective movement of the drill pipe from the surface. Preferably, the interior valve may be closed by placing the drill string in tension. This may occur while running into the well and also by lifting the drill bit from the bottom of the well. Also, preferably a retainer mechanism is employed with the valve for retaining the valve in either the open position or the closed position. The retainer mechanism is actuated in the preferred embodiment by rotating the drill string a selected increment.

In the one embodiment, the valve assembly has an outer member and an inner member, defining an inner passage and an annular passage for the fluid flow. The inner and outer members have upper and lower portions that are axially movable relative to each other. A valve is mounted in the inner member. The valve has one portion that moves with the upper portion of the inner and outer members. The other part of the valve remains stationary with the lower portions of the inner and outer members. Lifting the upper portion mechanically or hydraulically causes the two cooperative portions of the valve to move relative to each other, causing the valve to move to a closed position.

In another embodiment, particularly when the drill string is a dual passage type, the valve assembly also includes an annular valve assembly located within an annular passage surrounding an inner conduit.

The valve assembly is particularly for use with a drill string for drilling with a gaseous drilling fluid. The drill string is preferably of a dual passage type. Compressed gas flows down the annular passage, and returns up the inner passage along with cuttings.

DETAILED DESCRIPTION OF THE PREFERRED EMBODIMENT

Figure 1A:
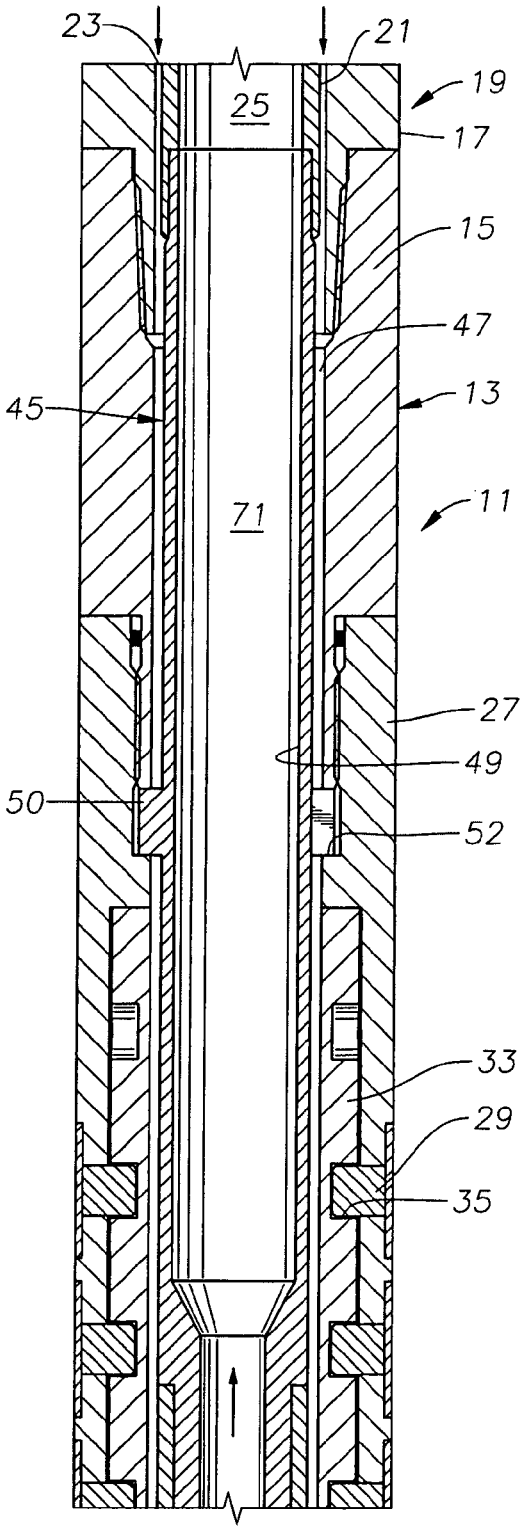
FIGS. 1A and 1B comprise a vertical sectional view of a valve assembly constructed in accordance with this invention and shown in an open position.

Referring to FIG. 1, valve assembly 11 includes an outer tubular member 13, which is made up of several components. An upper adapter 15 forms the upper end of outer member 13. Upper adapter 15 is a tubular member having threads on its upper end for connection to an outer conduit 17 of a dual passage drill string 19. Drill string 19 preferably has an inner conduit 21 extending through it. An annular passage 23 surrounds inner conduit 21, and an inner passage 25 extends through inner conduit 21. Inner conduit 21 and outer conduit 17 may be made of continuous coiled tubing, which is typically of metal. Alternately, outer conduit 17 may be made up of segments of pipe secured together, and inner conduit 21 could be formed of sections of pipe that stab together.

Outer member 13 also has an upper sub 27 that secures to the lower end of adapter 15. Upper sub 27 is a tubular member that has a plurality of pins 29 secured to it. Preferably there are two sets of pins 29, each pin 29 in each set being axially aligned with the others in the same set. The sets of pins 29 are spaced 180° apart and extend radially inward. Upper sub 27 also has a plurality of spaced apart downward facing lugs 31 on its lower end. Lugs 31 contact an upper shoulder of a lower sub 33 of outer member 13 when valve assembly 11 is in the retracted position shown in FIGS. 1A and 1B.

Figure 3:
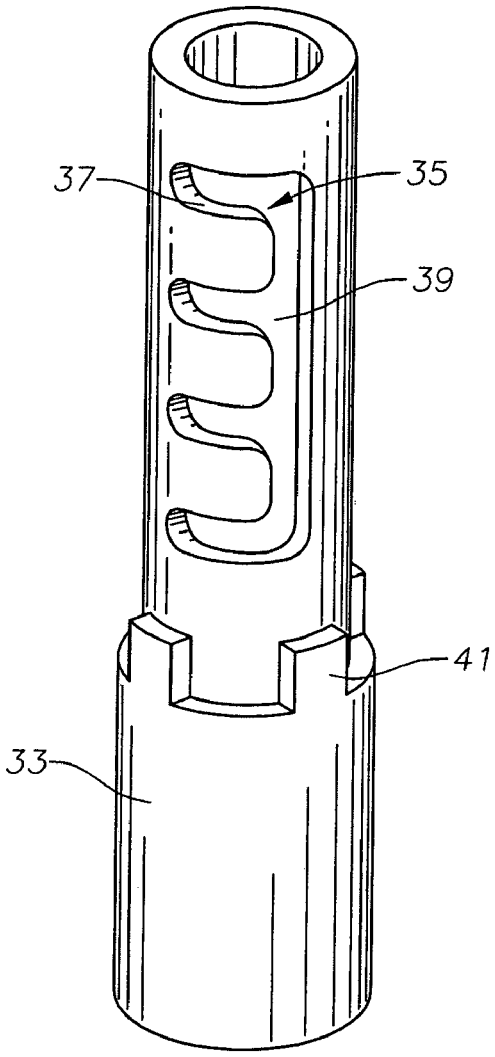
FIG. 3 is a perspective view of part of a lower sub of the outer member of the valve assembly of FIGS. 1A and 1B.

Lower sub 33 is a tubular member that has an upper reduced diameter portion that inserts into upper sub 27 and contains a pair of slots 35 for engagement by pins 29. Slots 35 are spaced 180° from each other in this embodiment. As shown in FIG. 3, each slot 35 has a plurality of transverse portions 37 that extend circumferentially about 90° and are parallel to each other. Each transverse portion 37 is perpendicular to the longitudinal axis of lower sub 33 and leads to an axial portion 39 that extends along the length of lower sub 33. Each slot 35 does not extend entirely through the sidewall of lower sub 33, thus does not communicate with the interior of the lower sub 33. Lower sub 33 also has a plurality upward facing lugs 41 that have spaces between them for receiving downward facing lugs 31 (FIG. 1B) of upper sub 27.

Figure 1B:
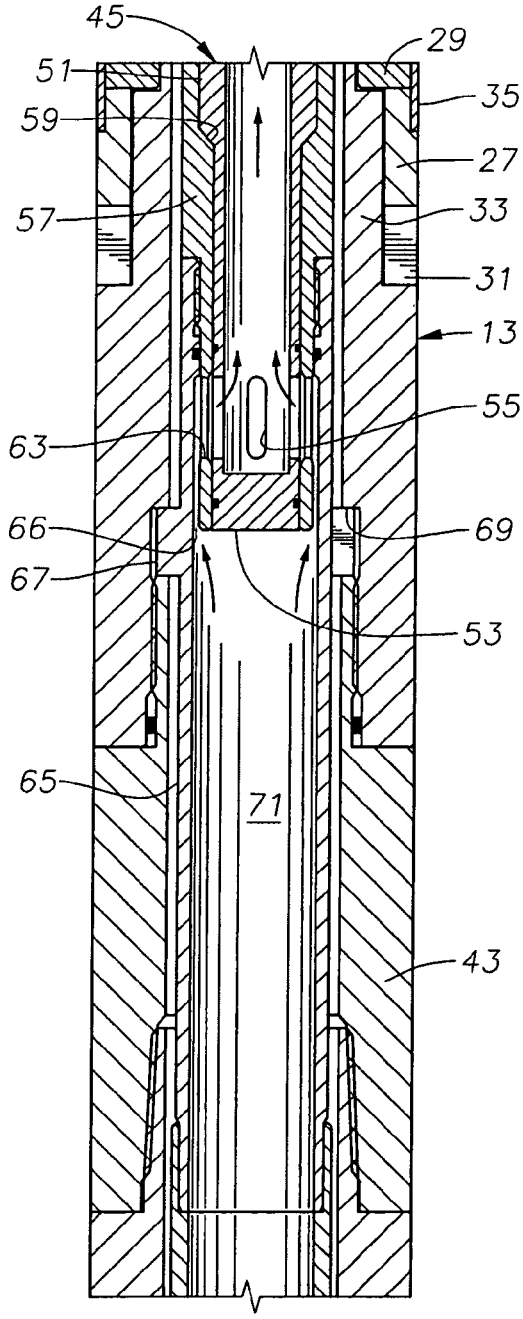

There are more transverse portions 37 of each slot 35 than pins 29. Each set has three pins 29 in this example, while there are four transverse portions 37 (FIG. 3) in each slot 35. Pins 29 are located in the lower three transverse slots 37 while valve assembly 11 is in the open and retracted position of FIGS. 1A and 1B. While in this position, lugs 31 and 41 are intermeshed with each other as shown in FIG. 1B. Each space between each upward extending lug 41 is wider than each downward extending lug 31. This allows upper sub 27 to rotate counterclockwise (looking downward) an increment relative to lower sub 33 while lugs 41 and 31 are intermeshed. While doing so, pins 29 will move from the transverse portions 37 to the axial portion 39. Then, upper sub 27 can move upward relative to lower sub 33 a short distance until the uppermost pin 29 of each set (FIG. 1B) contacts the upper end of axial portion 39. At this point, upper sub 27 can be rotated an increment clockwise relative to lower sub 33 to cause the three pins 29 to enter the upper three transverse portions 37.

The total number of transverse portions 37 should exceed the total number of pins 29, however the number could differ from the four transverse portions 37 and three pins 29 shown in the preferred embodiment. Although lugs 31, 41 allow limited rotation of upper sub 27 relative to lower sub 33, they will transmit torque once in engagement with each other.

Figure 2A:
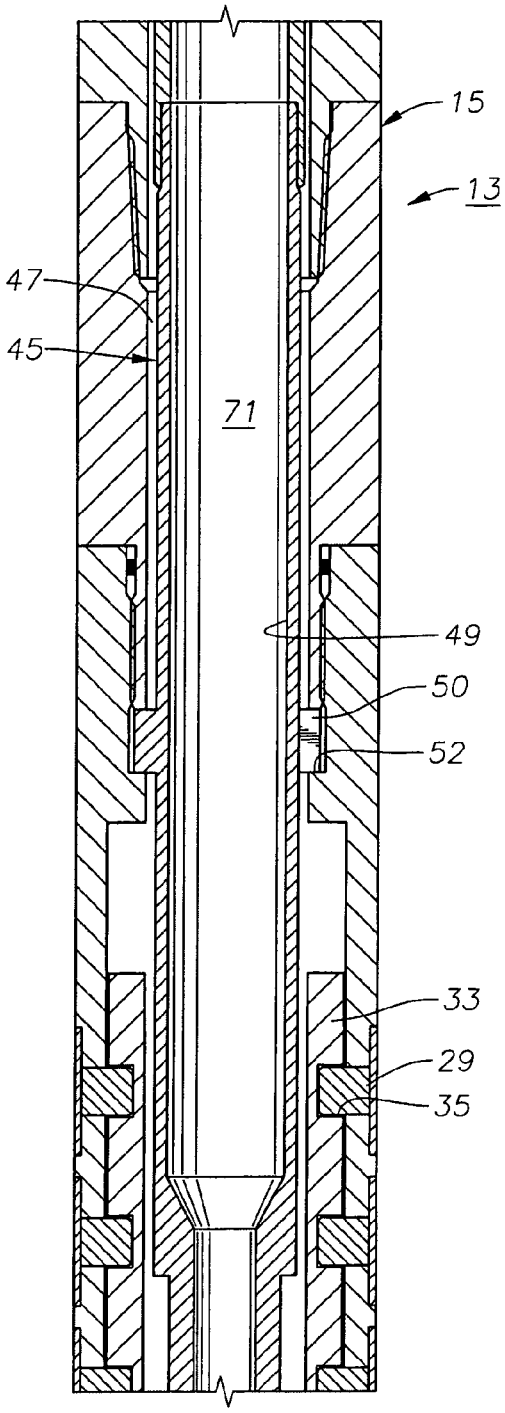
FIGS. 2A and 2B comprise a vertical sectional view of the valve assembly of FIGS. 1A and 1B, but shown in a closed position.
Figure 2B:
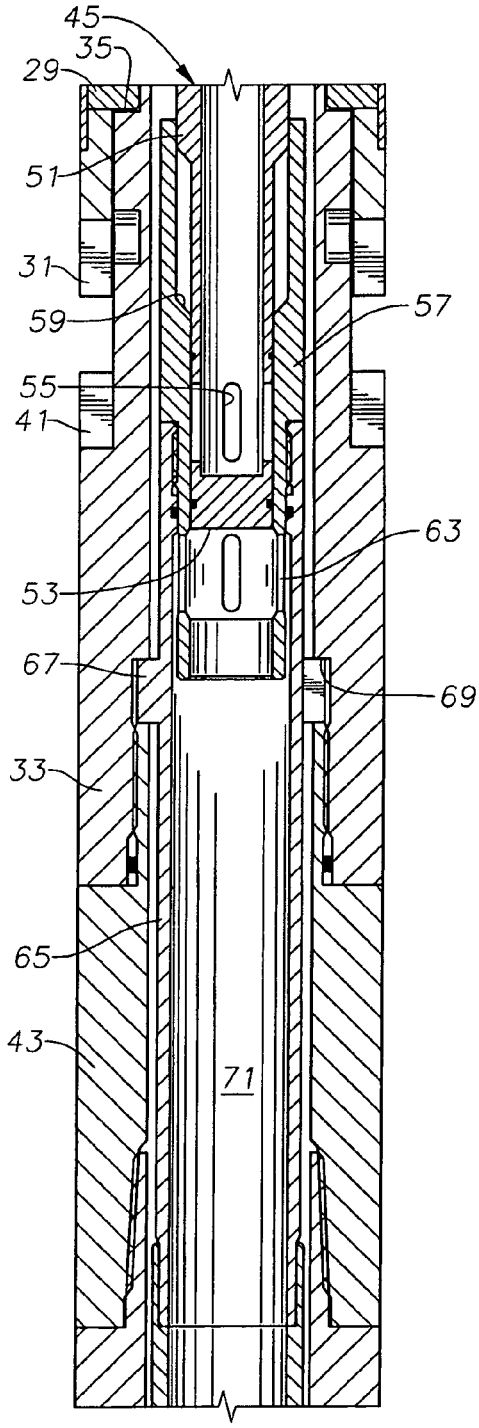

Referring again to FIG. 1B, a lower adapter 43 secures by threads to the lower end of lower sub 33. Lower adapter 43 has the same configuration as upper adapter 15 for connecting to another portion of drill string 19. Preferably lower adapter 43 connects into drill string 19 at a fairly close distance to a drill motor and bit assembly (not shown). Outer member 13 thus is made up of upper adapter 15, upper sub 27, lower sub 33 and lower adapter 43. The upper portion of outer member 13, which is made up of upper sub 27 and upper adapter 15, will telescope upward relative to the lower portion, which is made up of lower sub 33 and lower adapter 43. FIGS. 1A and 1B show the retracted position, while FIGS. 2A and 2B show the extended position.

An inner member 45 extends through outer member 13. Inner member 45 has a number of components, and its outer diameters are all less than the inner diameters of adjacent portions of outer member 13, resulting in an annular passage 47 between inner member 45 and outer member 13. Inner member 45 has a tubular upper portion 49 that joins inner conduit 21 of drill string 19. Inner upper portion 49 has outward extending lugs 50 that are received within a recess of upper sub 27. The recess is defined by an upward facing shoulder 52 of upper sub 27 and the lower end of upper adapter 15. Lugs 50 are spaced apart circumferentially from each other so as to not impede fluid flow through annulus 47. Lugs 50 and shoulder 52 prevent any axial movement of inner upper portion 49 relative to upper sub 27.

Inner upper portion 49 has a valve member 51 formed on its lower end. Valve member 51 comprises a tube that has a closed lower end 53. A plurality of ports 55 are located in the sidewall of valve member 51 directly above closed end 53. Valve member 51 lands within a valve sleeve 57, which has an upward facing conical shoulder 59 that provides a lower limit for the downward travel of valve member 51. Valve sleeve 57 sealingly receives closed end 53. A plurality of bypass ports 63 are located in valve sleeve 57, with each port 63 registering with one of the ports 55 when in the open position of FIGS. 1A and 1B.

An inner member lower tube 65 is secured to valve sleeve 57. The inner diameter of lower tube 65 is greater than the outer diameter of valve sleeve 57 at ports 63 by a selected amount to create an annular clearance 66. While in the position shown in FIG. 1B, fluid may flow upward, as indicated by the arrows, through clearance 66, ports 63, 55, and into the interior of valve member 51. Ports 63 and clearance 66 serve as a bypass to allow flow around closed end 53 of valve member 51 while in the open position.

Lower tube 65 is axially retained with a lower portion of outer member 13, which comprises lower sub 33 and lower adapter 43. This is handled by a plurality of lugs 67 on the exterior of lower tube 65. Lugs 67 locate within a recess that is formed by a downward facing shoulder 69 of lower sub 33 and the upper end of lower adapter 43. Lugs 67 are spaced apart circumferentially to allow fluid flow through annular passage 47.

An inner passage 71 extends through the various components of inner member 45. Inner member 45, like outer member 13, has an upper portion that moves axially relative to a lower portion. The upper portion is made up of inner upper portion 49 and valve member 51. The lower portion of inner member 45 is made up of valve sleeve 57 and lower tube 65.

In operation, valve assembly 11 is connected into drill string 19 at a point near the lower end of the drill string.

Typically, the operator would place valve assembly 11 in a closed position prior to running drill string 19 into the well. This may be done at the drill rig floor by restraining lower adapter 43 against rotation while rotating outer adapter 13 about one-fourth turn in a counterclockwise direction looking downward. This causes pins 29 (FIG. 1B) to move from transverse portions 37 to axial portion 39 (FIG. 3). Either before or after the incremental rotation, the operator suspends valve assembly 11 vertically. This causes upper sub 27 and its pins 29 to move upward relative to lower sub 33 and its slot 35 (FIG. 3). When the upper pins 29 reach the upper ends of axial slots 39, the operator rotates upper adapter 15 one-fourth turn back clockwise relative to lower adapter 43. Pins 39 are now in the upper three transverse slot portions 37 (FIG. 3). Pins 39 and transverse slot portions 37 of slot 35 thus serve as a retainer to maintains valve assembly 11 in the extended position.

As upper sub 27 moves upward relative to lower sub 33, valve member 51 also moves upward relative to valve sleeve 57. Closed lower end 53 moves upward to the position of FIG. 2B above ports 63 in valve sleeve 57. Any upward flow through inner passage 71 will be blocked by closed end 53.

When the drill bit reaches the bottom of the well, the operator will open valve assembly 11 by rotating drill string 19 one-fourth turn counterclockwise. Because of the weight of drill string 19 on valve assembly 11, the lower portion of outer member 13, including lower sub 33, does not rotate, thus causing each set of pins 39 to now enter axial portion 39 of slot 35 (FIG. 3). The operator allows the weight of the drill string above valve assembly 11 to move the upper portion of outer member 13 downward relative to the lower portion of outer member 13 until lugs 31 contact the shoulders between lugs 41. Outer member 13 will then be in compression. At this point, pins 29 (FIG. 1B) will be in alignment with the three lower transverse portions 37 (FIG. 3). The operator rotates drill string 19 one-fourth turn clockwise, causing upper sub 27 to rotate relative to lower sub 33, placing pins 29 at the ends of the transverse portions 37. At the same time the upper portion of outer member 13 moved downward, valve member 51 also moved downward in valve sleeve 57 to the position shown in FIG. 1B. Ports 63 and 55 will now align with each other, placing valve assembly 11 in an open position.

The operator pumps a fluid down annular passage 23, the fluid typically being a gas such as air. The fluid flows down annular passage 47 and is used to drive the drill motor to rotate the drill bit (not shown) while drill string 19 remains stationary. Cuttings and return air flow up inner passage 71, through clearance 66 and ports 63 and 55 into the interior of valve member 51. The fluid continues to flow up inner passage 71 into inner passage 25 of drill string 19. When the operator wishes to close valve assembly 11, he simply reverses the steps mentioned above. Normally, when tripping the drill string 19 out of the well such as to change the drill bit, the operator will close the valve assembly.

The invention has significant advantages. The valve assembly provides a safety shutoff to prevent the flow of gas or other formation fluids up through the drill string, particularly while running the drill string into the well or retrieving the drill string from the well. The valve assembly is particularly useful when drilling into deep coal beds that contain methane gas. The use of air as a drilling medium avoids having to utilize liquid drilling fluids, which tend to encroach into and damage such formations. The valve is easily moved between open and closed positions by manipulating the drill string. The valve can be retained in either the open or closed position.

Referring to FIGS. 7A through 9B, an alternative valve assembly 111 shows an apparatus that is capable of locking an inner passageway 171 and annular passage 147. A valve member 151 operates substantially the same as valve member 51 shown in FIG. 1A through FIG. 6. In valve assembly 111, an additional annular valve assembly 181 regulates fluid flow through annular passage 147. In this alternative embodiment, an outer tubular member 113 includes an upper adapter 115 extending axially upward from upper sub 127, which is another portion of outer member 113, and located above valve member 151. Upper adapter 115 connects to an outer conduit 117 of a dual passage drill string 119.

An inner member 145 extends axially upward from upper sub 127 through upper adapter 115 away from valve member 151. Inner member 145 defines an inner passage 125. Inner member 145 and upper sub 127 also defines an annular passage 123. Both inner and annular passages 123, 125 extend axially upward from valve member 151, toward valve assembly 181.

Outer tubular member also includes an annular valve housing 183 that receives an upper portion of upper adapter 115 and encloses the inner portions of valve assembly 181 from the well formation. Annular valve assembly 181 also includes a valve portion 185 of inner tubular member 145 extending axially through annular valve assembly 181. Inner passage 125 extends axially through valve portion 185 of inner tubular member 145. Valve portion 185 provides a physical barrier to the gaseous fluid flowing through annular passage 147 from entering inner passage 125 within annular valve assembly 181. A valve seat 187 is formed on the outer surface of valve portion 185 of tubular member 145. Valve seat 187 preferably extends radially outward from the outer surface of valve portion 185 of inner tubular member 145. The combination of valve seat 187, the inner surface of annular valve housing 183 and the outer surface of valve portion 185 defines upper and lower annular valve chambers 189, 191. Annular passage 147 extends axially upward from valve assembly 151 toward valve assembly 181 and opens into lower annular valve chamber 189. Annular passage 123 extends axially downward toward valve assembly 181 and opens into upper annular valve chamber 191.

An annular valve passage 193 extends axially through valve seat 187. Preferably, there are a plurality of axial annular valve passages 193 extending through valve seat 187. Lower chamber 189 and upper chamber 191 are in fluid communication with each other through annular valve passages 193. A valve piston 195 selectively engages valve seat 187 and annular valve passages 193 to open and close valve assembly 181. Preferably, valve piston 195 surrounds the outer surface of valve portion 185 of inner tubular member 145. Preferably, valve piston 195 is located below valve seat 187 and slidingly engages valve portion 185 for selective engagement with valve passages 193.

Figure 8A:
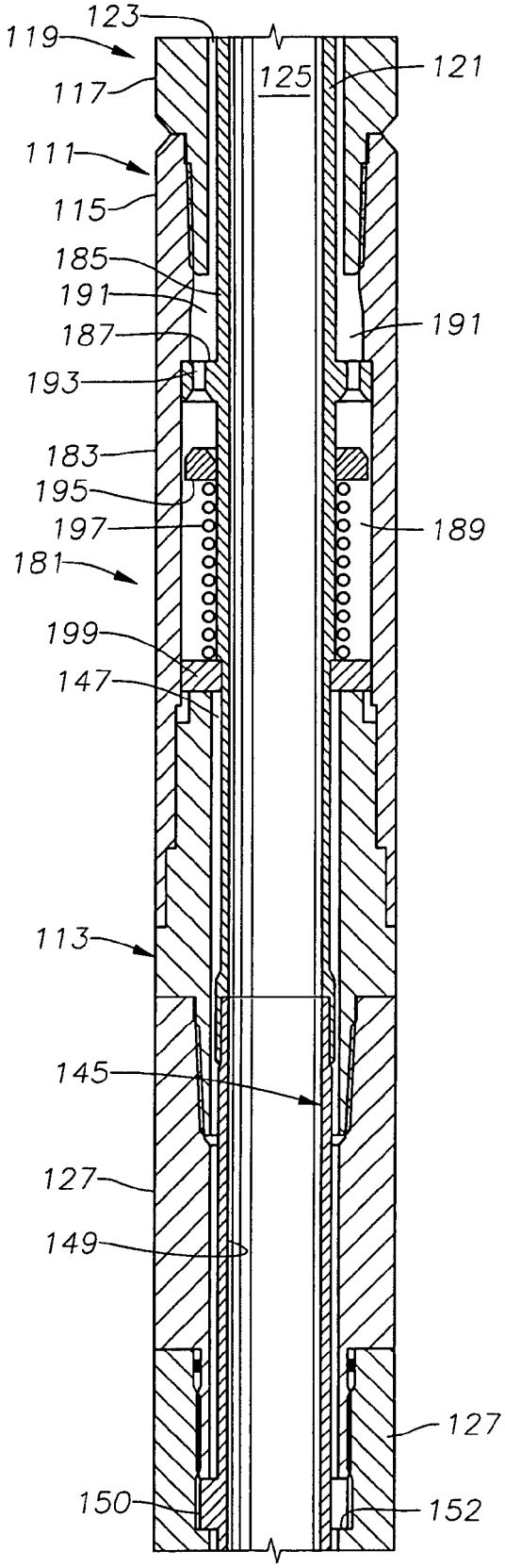
FIGS. 8A and 8B comprise a vertical sectional view of the valve assembly of FIGS. 7A and 7B, but shown in an open position.
Figure 8B:
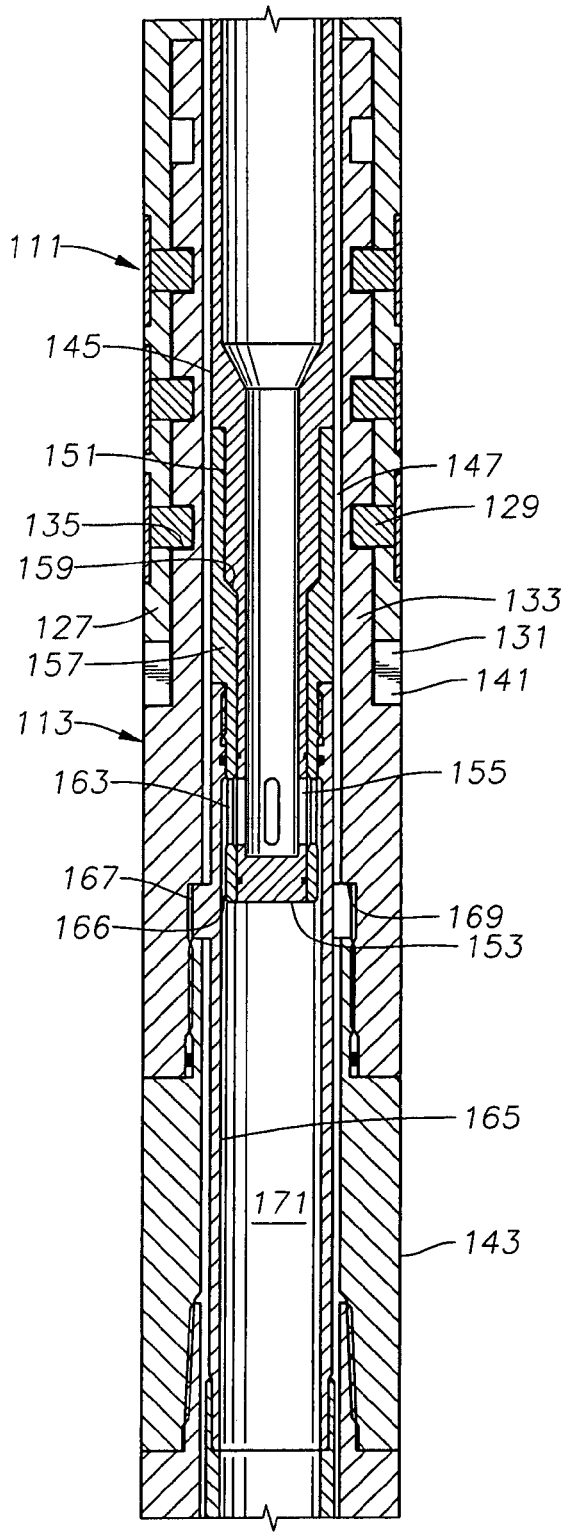

A valve spring 197 located below valve piston 195 biases valve piston 195 toward engagement with annular valve passages 193 and valve seat 187. A spring retainer located below valve spring 197 provides a physical barrier that engages valve spring 197 and forces valve sprint 197 to bias valve piston 195 toward valve seat 187. Preferably, valve spring 197 has a predetermined spring coefficient such that a predetermined gaseous fluid pressure in annular passage 123 actuates valve spring 197 away from valve seat 187 so that valve assembly 181 is in an open position as shown in FIG. 8A.

When the gaseous fluid pressure within annular passage 123 is below a predetermined amount valve spring 197 actuates valve piston 195 toward valve seat 187, thereby closing valve passages 193 and blocking fluid flow from lower chamber 189 to upper chamber 191. Valve piston 195 is shown in its closed position in FIG. 7A.

Figure 7A:
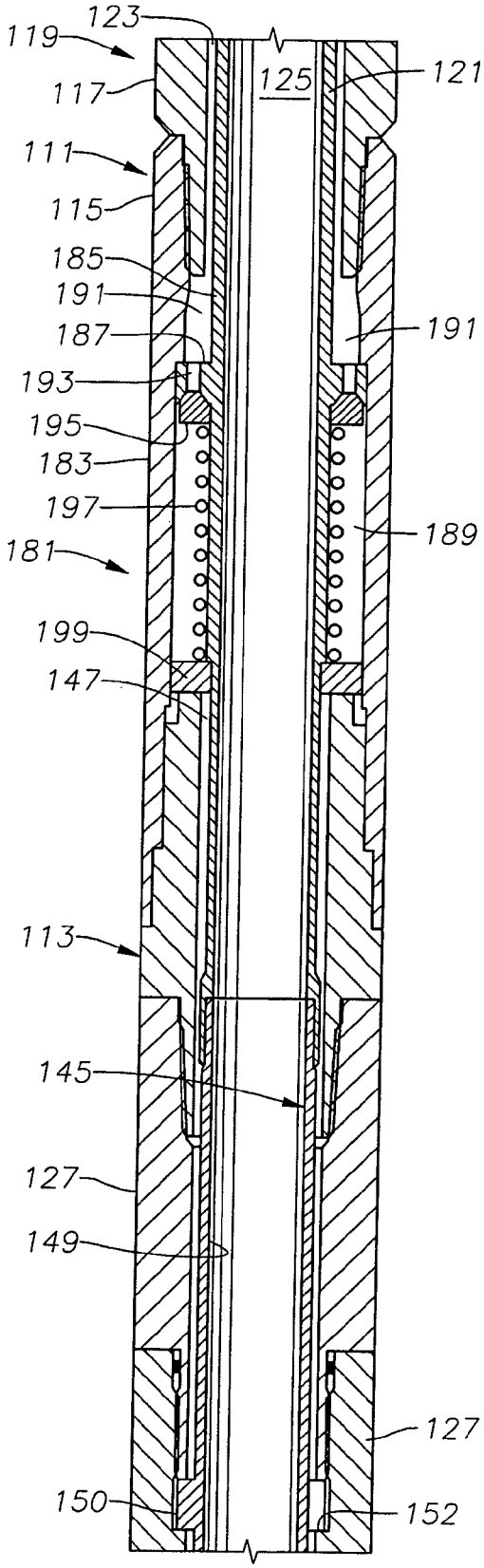
FIGS. 7A and 7B comprise a vertical sectional view of a valve assembly constructed in accordance with an alternative embodiment of this invention in a closed position.
Figure 7B:
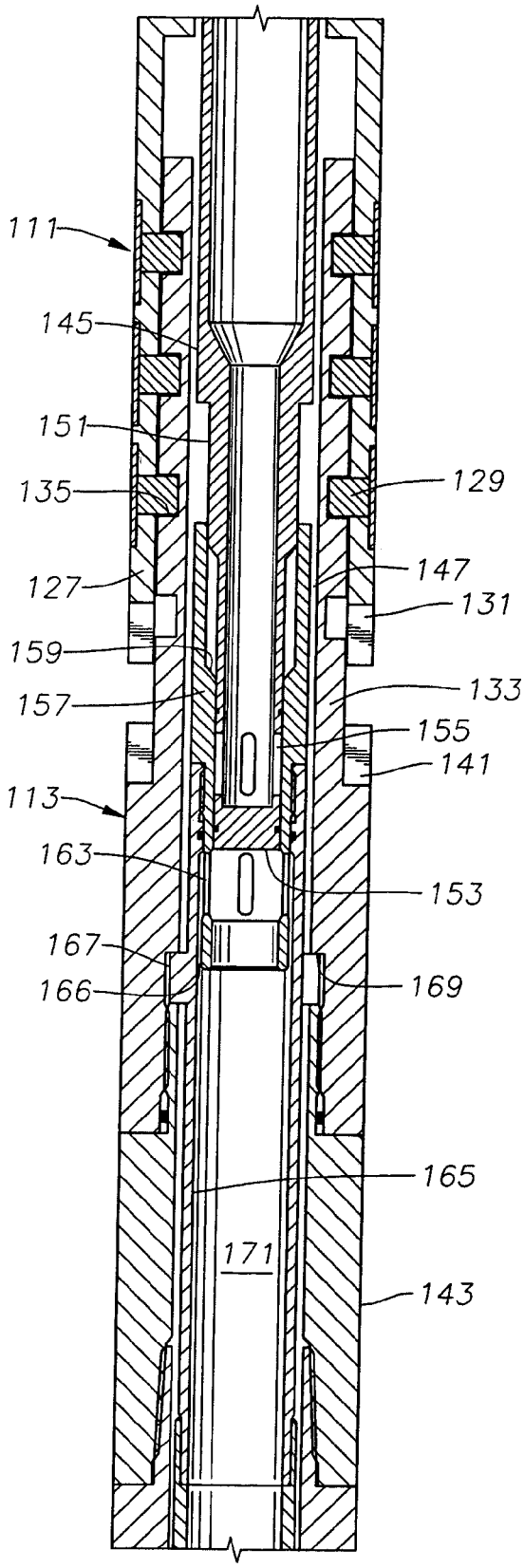
Figure 9A:
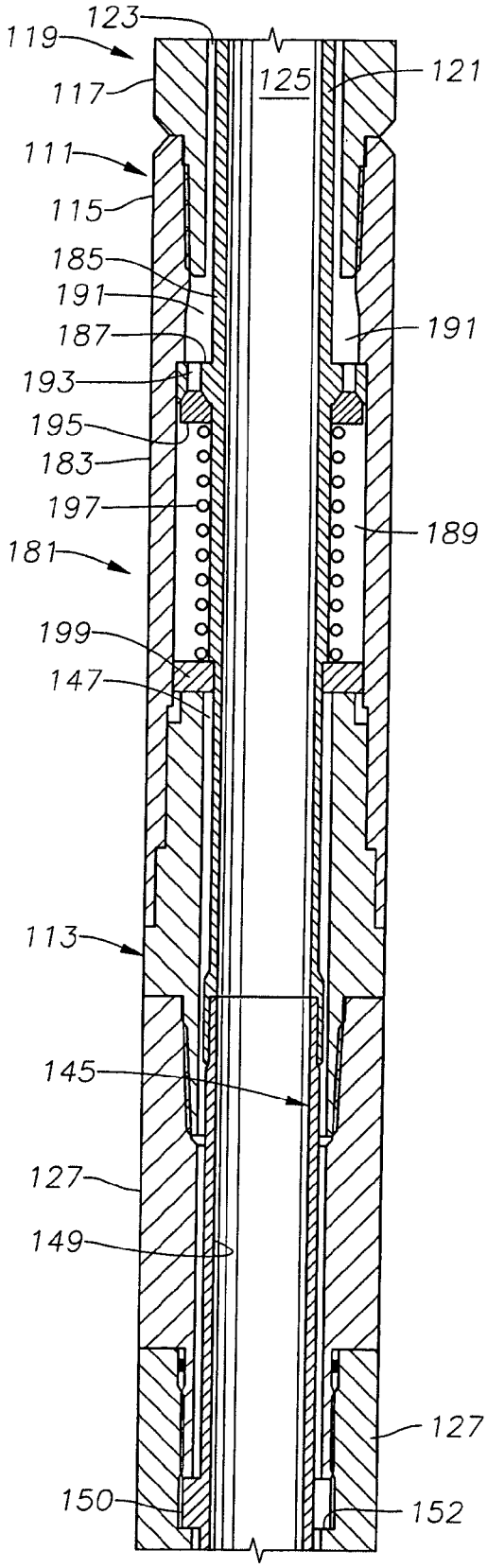
FIGS. 9A and 9B comprise a vertical sectional view of the valve assembly of FIGS. 7A and 7B, but shown with one valve open and one valve closed.
Figure 9B:
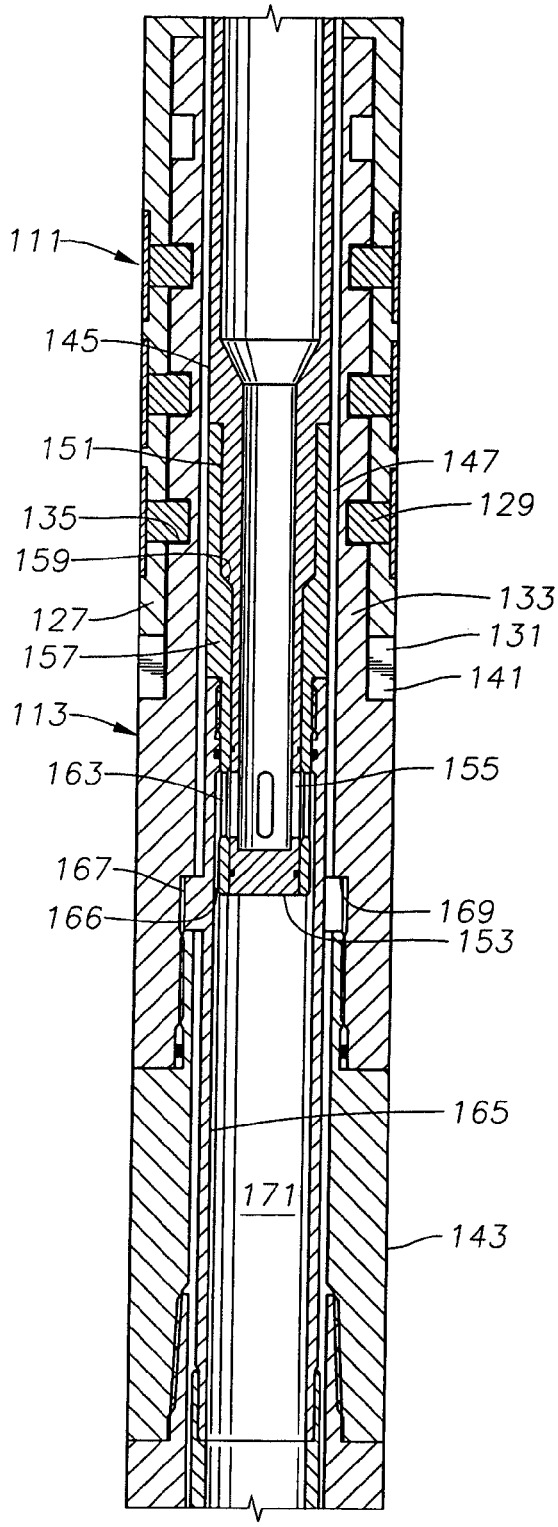

FIGS. 7A through 9B show a variety of arrangements for operators to utilize during operations. FIG. 7A and FIG. 7B show valve assembly 111 with valve member 151 and annular valve 181 in their closed positions. Valve member 151 is actuated in substantially the same manner as valve member 51 is actuated in FIGS. 1A through 6. FIGS. 8A and 8B show valve assembly 111 with valve member 151 in its closed position thereby preventing flow of fluid through inner passage 125, while annular valve 181 is in its open position thereby allowing gaseous fluid flow through annular passage 123, 147. FIGS. 9A and 9B show valve member 151 in its open position thereby allowing flow of fluids through inner passage 125, while annular valve passage 181 is in its closed position thereby blocking fluid flow between annular valve passage 123, 147. Valve assembly 111 provides an operator with an additional way to close fluid flow during drilling operations through both the inner and outer passages extending up through dual passage drill string 119. When it is desired to shut down fluid flow through outer passages 123, 147, operator merely stops supplying fluid through valve assembly 181.

Figure 10:
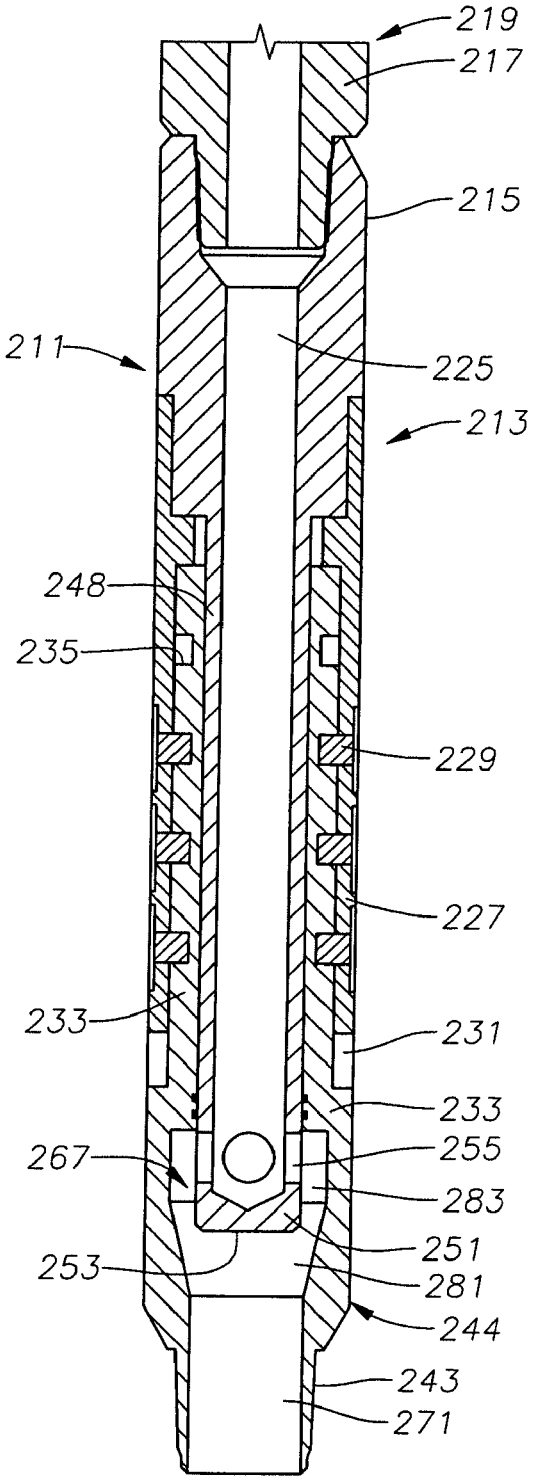
FIG. 10 comprises a vertical sectional view of a valve assembly constructed in accordance with the invention for a single passage drill string and in an open position.
Figure 11:
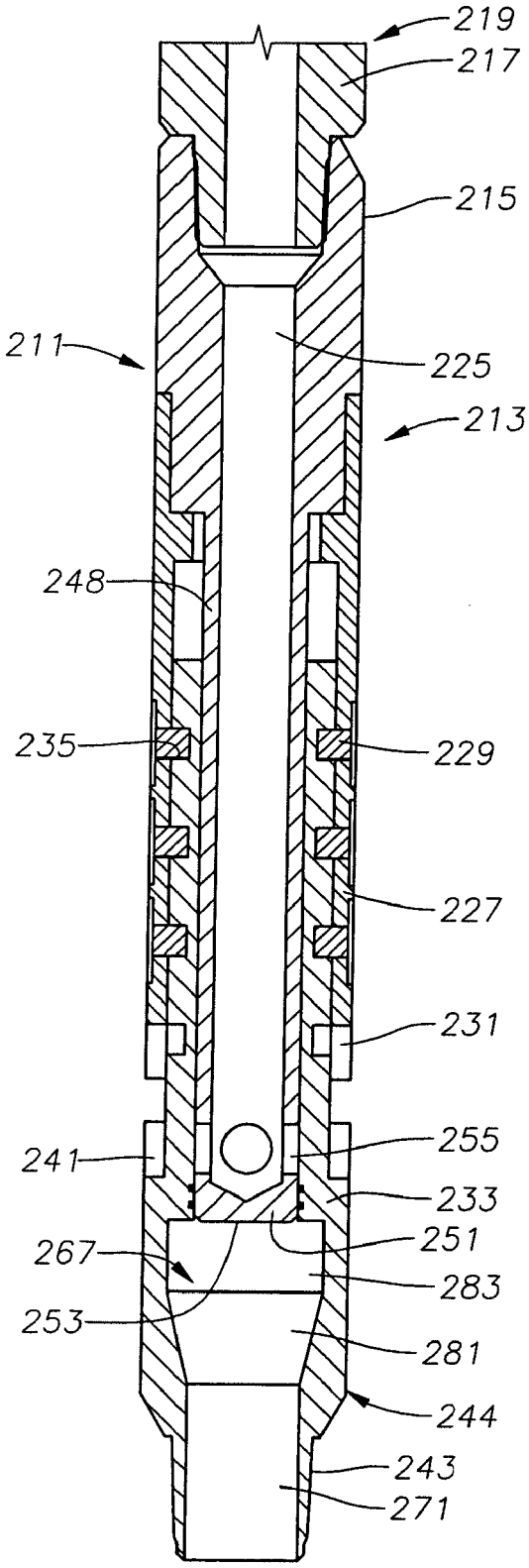
FIG. 11 comprises a vertical sectional view of the valve assembly of FIG. 10, but shown in a closed position.

Referring to FIGS. 10 and 11, another alternative valve assembly 211 is shown for use in drilling operations when a single passage dual string is desired. Outer tubular member 213 preferably includes an upper adapter 215 connected to a single passage drill string 217. Upper adapter 215 connects single passage drill string 217 to valve assembly 211. Upper adapter 215 includes a tubular member portion extending axially downward within portions of outer tubular member 213 below upper adapter 215. Outer tubular member 213 preferably includes an upper sub 227 that attaches to and encloses a portion of upper adapter 215 above tubular member 248. Upper sub 227 extends axially downward and encloses a substantial portion of tubular portion 248 of upper adapter 215. Tubular member 248 has an axial bore defining inner passage 225 which is in fluid communication with the interior of conduit 217. Upper sub 227 is substantially similar to upper sub 27 shown in FIG. 1A through FIG. 6, upper adapter 215 is substantially similar to upper adapter 15 and tubular upper portion 49 shown in FIG. 1A through FIG. 6 except that there is not an annular passage 23 extending therethrough.

A lower connector 244 extends below valve assembly 211 toward a drill motor and drill bit (not shown). Lower connector 244 preferably includes a lower sub portion 233 and a lower adapter portion 243. Lower sub portion 233 extends between tubular member 248 and upper sub 227 from below upper sub 227. Lower adapter portion 243 connects to a lower end of lower sub portion 233, or forms the lower portion of lower connector 244 below lower sub portion 233, and extends axially downward below valve assembly 211 toward the drill bit (not shown). Lower adapter portion 243 defines a lower passage 271, which is part of inner passage 225 extending through conduit 217, and valve assembly 211.

Figure 4:
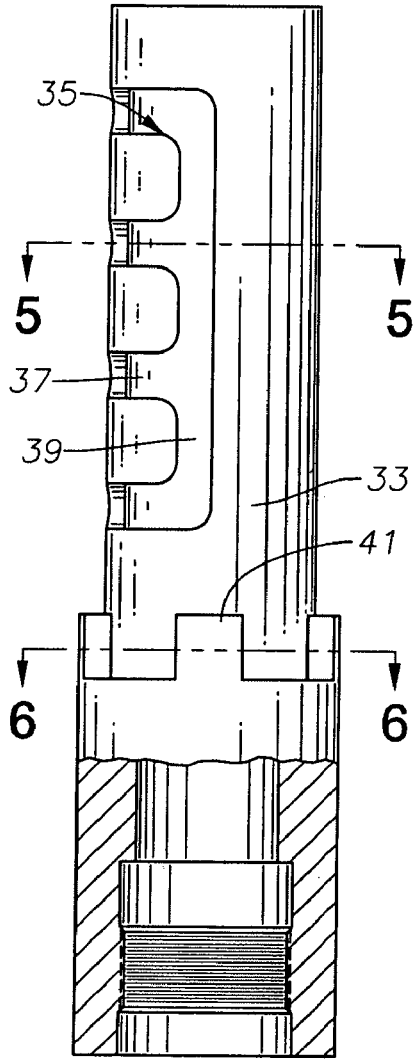
FIG. 4 is a side elevational view, partially sectioned, of the lower sub of FIG. 3.
Figure 5:
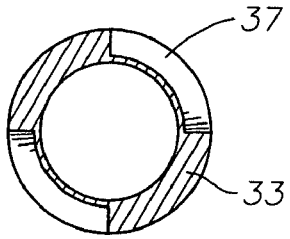
FIG. 5 is a sectional view of the lower sub of FIG. 3, taken along the line 5—5 of FIG. 4.
Figure 6:
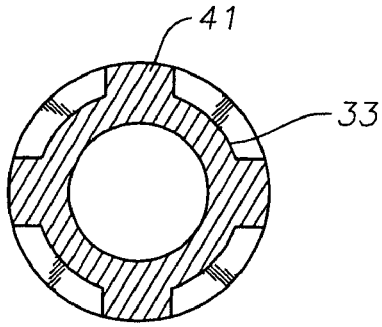
FIG. 6 is a sectional view of the lower sub of FIG. 3, taken along the line of 6—6 of FIG. 4.

A plurality of pins 229 engage a plurality of slots 235 in substantially the same manner as pins 29 and slots 35 engage each other in FIG. 1A through FIG. 6. Pins 229 slide through slots 235 along axial portions (39 as shown in FIGS. 3 and 4) for allowing valve assembly 211 to move between its extended and retracted positions to open valve assembly 211. Pins 229 slide through traverse portions (37 as shown in FIGS. 3 and 4) while actuating valve assembly 211 between its extended and retracted positions as shown in FIGS. 10 and 11 in substantially the same manner as the invention shown in FIGS. 1A through 6.

A valve member 251 is positioned toward a lower portion of tubular member 248 for regulating flow through inner passage 225. Valve member 251 sealingly engages an interior surface of lower sub portion 233 while valve assembly 211 is in its extended position shown in FIG. 10. Valve member 251 extends below lower sub portion 233 and into lower adapter portion 243 while valve assembly 211 is in its retracted position to thereby open valve assembly 211. Valve member 251 includes a lower end 253 which prevents fluid flow through inner passage 225 while valve assembly 211 is in the extended position shown in FIG. 11. Valve member 251 preferably includes a plurality of ports 255 extending through a side of tubular member 248. When valve assembly 211 is in its retracted position, ports 255 extend below lower sub portion 233 and allow fluid flow through valve assembly 211 and the entirety of inner passage 225.

An annular clearance 267, formed within lower adapter 243, allows gaseous fluid flow around valve member 251 to ports 255. Preferably, lower adapter portion 243 includes a valve receiving portion 283 having an inner circumference larger than the inner circumference of lower sub portion 233. The larger inner circumference of valve receiving portion 283 defines annular clearance 267 around valve member 251. Lower adapter portion 243 also includes a fluted portion 281, which increases in diameter between the portion of lower adapter 243 defining lower inner passage 271, and receiving portion 283.

In operation, when valve assembly 211 is in its retracted and open position, gaseous fluid flows upward from the drill bit (not shown) through inner passage 271 toward valve assembly 211. Fluid flows from valve passage 271 through fluted portion 281 into valve receiving portion 283 surrounding valve member 251, which is extending below lower sub portion 233 into lower adapter portion 243. Fluid flows from valve receiving portion 283 through valve ports 255 into valve member 251. From valve member 251 fluid can flow within inner passage 225 through valve assembly 211 to conduit 217. Alternatively, fluid flow can be reversed so that the gaseous fluid flows down inner passage 225 and through valve assembly 211 and into inner valve passage 271 before discharging into the well formation through drill bit 221. The gaseous fluid and cuttings circulate to the surface along the outer surface of conduit 217. Referring to FIG. 11, while valve assembly 211 is in its extended or closed position, valve member 251 sealingly engages the inner surface of lower sub portion 233. Closed lower end 253 prevents fluid flow between inner passage 225 and inner passage 271. As mentioned previously, valve assembly 211 is actuated between its extended and retracted positions shown in FIGS. 10 and 11 in the same manner as valve assembly 11 in FIG. 1A through FIG. 6 is actuated between extended and retracted positions.

While the invention has been shown in only some of its forms, it should be apparent to those skilled in the art that it is not so limited but is susceptible to various changes without departing from the scope of the invention. For example, while the valve shows a valve member that moves with the upper portion of the valve while the valve sleeve remains stationary with the lower portion of the valve assembly, these could be reversed. Furthermore, the pins could protrude outward from an inner member and the slot located on an inner diameter of an outer member.

What is claimed is:

1. An apparatus for opening and closing a passageway of a drill string, comprising:

a tubular outer member having upper and lower portions that telescopingly engage one another and are axially movable relative to each other between a retracted position and an extended position, the outer member having a bore through each of the upper and lower portions of the outer member;

a locking mechanism located between the upper and lower portions of the outer member, the locking mechanism selectively locks the upper and lower portions between the retracted and extended positions;

a valve member carried in the bore for blocking upward flow through the bore, the valve member being mounted to one of the upper and lower portions for movement therewith; and while the upper and lower portions of the outer member are in the retracted position, the valve member allows upward flow through the bore, and while the upper and lower portions of the outer member are in the extended position, the valve member blocks flow through the bore.

2. The apparatus according to claim 1, further comprising an inner tubular member carried in the bore of the upper portion of the outer member, the inner tubular member defining an inner passageway extending axially through the upper portion of the outer member.

3. The apparatus according to claim 2, wherein the inner passageway is in fluid communication with the bore of the lower portion of the outer member when the upper and lower portions are in the retracted position.

4. The apparatus according to claim 2 wherein the valve member blocks fluid communication between the inner passageway and the bore of the lower portion of the outer member when the upper and lower portions are in the extended position.

5. The apparatus according to claim 2 wherein the inner tubular member defines an annular passageway between the bore of the outer member and the tubular member.

6. The apparatus according to claim 5, wherein the bore of the upper portion and lower portions of the outer member are in fluid communication through the annular passageway when the outer member is in the retracted and extended positions.

7. The apparatus according to claim 5, wherein the valve member allows flow through the annular passageway while the upper and lower portions of the outer member are in the retracted and extended positions.

8. The apparatus according to claim 1, wherein the valve member further comprises a lower end free of apertures.

9. The apparatus according to claim 1, wherein the valve member further comprises an opening extending through a side of the valve member.

10. The apparatus according to claim 1, wherein the outer member connects to a conduit of a drill string having a passage extending axially therethrough.

11. The apparatus according to claim 1, wherein the outer member connects to a conduit of a drill string having at least two passages extending axially therethrough.

12. An apparatus for opening and closing a passageway of a drill string, comprising:

a tubular outer member having upper and lower portions that telescopingly engage one another and are axially movable relative to each other between a retracted position and an extended position, the outer member having a bore through each of the upper and lower portions of the outer member;

a locking mechanism located between the upper and lower portions of the outer member, the locking mechanism selectively locks the upper and lower portions between the retracted and extended positions;

an inner tubular member carried in the bore of the outer member, the inner tubular member defining an inner passageway and an annular passageway extending axially through the outer member;

an inner valve member carried in the bore for blocking upward flow through the inner passageway, the inner valve member being mounted to one of the upper and lower portions for movement therewith; and while the upper and lower portions of the outer member are in the retracted position, the valve member allows upward flow through the inner passageway, and while the upper and lower portions of the outer member are in the extended position, the valve member blocks flow through the inner passageway.

13. The apparatus according to claim 12, further comprising an annular valve assembly carried in the bore of the tubular outer member blocking upward flow through the annular passageway.

14. The apparatus according to claim 13, wherein the annular valve assembly is located between the bore of the tubular outer member and the exterior of the tubular outer member.

15. The apparatus according to claim 13, wherein the annular valve assembly actuates to an open position when pressure above the annular valve assembly reaches a predetermined amount.

16. The apparatus according to claim 13, wherein the annular valve assembly actuates to a closed position when the pressure above the annular valve assembly is below a predetermined amount.

17. The apparatus according to claim 13, wherein the annular valve assembly further comprises a valve seat having at least one opening extending axially therethrough, and a valve piston that selectively engages the valve seat and closes the opening.

18. The apparatus according to claim 17, wherein the annular valve assembly further comprises a valve spring that engages the valve piston for actuating the valve piston into and out of engagement with the valve seat.

19. The apparatus according to claim 12, wherein the outer member connects to a conduit of a drill string having at least two passages extending axially therethrough.

20. The apparatus according to claim 19, wherein said at least two passages comprises an inner passage and an annular passage, the inner passage being in fluid communication with the inner passageway and the annular passage being in fluid communication with the annular passageway when the conduit and the outer member are connected.

21. A method for opening and closing a passage of a drill string, comprising:

providing a tubular outer member having upper and lower portions that telescopingly engage one another and are axially movable relative to each other between a retracted position and an extended position, an inner passageway extending through the upper and lower portions, and a valve member for blocking flow through the inner passageway between upper and lower portions;

closing the inner passageway by sliding the upper and lower portions axially away from each other to the extending position;

opening the inner passageway by sliding the upper and lower portions axially toward each to the retracted position; and selectively locking the upper and lower portions in the extended and retracted positions.

22. A method for opening and closing a passage of a drill string, comprising:

providing a tubular outer member having upper and lower portions that telescopingly engage one another and are axially movable relative to each other between a retracted position and an extended position, an inner passageway extending through the upper and lower portions, a valve member for blocking flow through the inner passageway between upper and lower portions, and providing an annular passageway extending through the upper and lower portions;

closing the inner passageway by sliding the upper and lower portions axially away from each other to the extending position; and opening the inner passageway by sliding the upper and lower portions axially toward each to the retracted position.

23. The method for opening and closing a passage of a drill string according to claim 22, further comprising:

providing an annular valve assembly located with the annular passageway;

opening the annular valve assembly by increasing the fluid pressure in the portion of the annular passageway above the annular valve assembly; and closing the annular valve assembly by reducing the fluid pressure in the portion of the annular passageway above the annular valve assembly.

* * * * *

UNITED STATES PATENT AND TRADEMARK OFFICE

CERTIFICATE OF CORRECTION

PATENT NO. : 7,017,682 B2
APPLICATION NO. : 10/677871
DATED : March 28, 2006
INVENTOR(S) : Kwong-Onn C. Chan et al.

It is certified that error appears in the above-identified patent and that said Letters Patent is hereby corrected as shown below:

Column 1, line 55, delete “a” before “hammer”
Column 5, line 14, delete “39” and insert - -29- -
Column 5, line 15, delete “39” and insert - -29- -
Column 5, line 16, delete “maintains” and insert - -maintain- -
Column 5, line 28, delete “39” and insert - -29- -
Column 6, line 58, delete “sprint” and insert - -spring- -

Signed and Sealed this

Twenty-second Day of August, 2006

JON W. DUDAS
*Director of the United States Patent and Trademark Office*